US011512713B2

(12) United States Patent
Vyvey

(10) Patent No.: US 11,512,713 B2
(45) Date of Patent: Nov. 29, 2022

(54) INNER SHROUD AND ORIENTABLE VANE OF AN AXIAL TURBOMACHINE COMPRESSOR

(71) Applicant: Safran Aero Boosters SA, Herstal (BE)

(72) Inventor: Morgan Vyvey, Flemalle (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 634 days.

(21) Appl. No.: 15/681,162

(22) Filed: Aug. 18, 2017

(65) Prior Publication Data

US 2018/0058471 A1 Mar. 1, 2018

(30) Foreign Application Priority Data

Aug. 30, 2016 (BE) ..... 2016/5663

(51) Int. Cl.

| | |
|---|---|
| ***F04D 29/56*** | (2006.01) |
| ***F01D 9/04*** | (2006.01) |
| ***F01D 17/16*** | (2006.01) |
| ***F04D 29/08*** | (2006.01) |
| ***F04D 29/54*** | (2006.01) |

(52) U.S. Cl.

CPC ..... *F04D 29/563* (2013.01); *F01D 9/042* (2013.01); *F01D 17/162* (2013.01); *F04D 29/083* (2013.01); *F04D 29/542* (2013.01); *F05B 2240/12* (2013.01); *F05D 2240/50* (2013.01); *F05D 2240/80* (2013.01)

(58) Field of Classification Search

CPC .... F01D 17/162; F01D 9/042; F05B 2240/12; F05B 2240/11; F05D 2240/50; F05D 2240/80; F05D 2240/52; F05D 2240/54; F05D 2240/90

See application file for complete search history.

(56) References Cited

U.S. PATENT DOCUMENTS 4,834,613 A * 5/1989 Hansen ..... F01D 17/162 415/160
5,639,212 A * 6/1997 Schaefer ..... F01D 11/001 415/173.1

(Continued)

FOREIGN PATENT DOCUMENTS

EP 0298894 A1 1/1989
FR 2824593 A1 11/2002

(Continued)

OTHER PUBLICATIONS

European Search Report from corresponding Belgium Application No. BE 201605663, dated May 10, 2017.

*Primary Examiner* — Grant Moubry
*Assistant Examiner* — Ruben Picon-Feliciano
(74) *Attorney, Agent, or Firm* — Sandberg Phoenix & von Gontard PC

(57) ABSTRACT

An assembly for the compressor stator of a turbomachine. The assembly comprises: a shroud, in various instances an inner shroud, that is axially divided into two parts; a pocket formed in the shroud; a bearing located in the pocket; and an orientable vane pivotably mounted in the bearing about a pivot axis. The shroud comprises an axial interface separating the parts that is axially offset from the pivot axis of the orientable vane. The invention also provides a process for assembling the assembly.

10 Claims, 4 Drawing Sheets

(56) References Cited

U.S. PATENT DOCUMENTS

| | | | | |
|---|---|---|---|---|
| 7,713,022 | B2 * | 5/2010 | Major | F01D 17/162 415/160 |
| 8,376,692 | B2 * | 2/2013 | Stiehler | F01D 17/162 415/160 |
| 9,932,988 | B2 * | 4/2018 | Maliniak | F01D 17/162 |
| 2009/0208338 | A1 * | 8/2009 | Major | F01D 17/162 416/215 |
| 2012/0082545 | A1 | 4/2012 | Peck et al. | |

FOREIGN PATENT DOCUMENTS

| | | | |
|---|---|---|---|
| FR | 3009335 | A1 | 6/2015 |
| GB | 749577 | A | 5/1956 |

* cited by examiner

INNER SHROUD AND ORIENTABLE VANE OF AN AXIAL TURBOMACHINE COMPRESSOR

CROSS-REFERENCE TO RELATED APPLICATIONS

This application claims the benefit, under 35 U.S.C. § 119, of BE 2016/5663 filed Aug. 30, 2016, the disclosure of which is incorporated herein by reference in its entirety.

FIELD

The invention relates to the field of the orientable vanes of axial turbomachines. More specifically, the invention relates to the pivot connection between an inner shroud and an orientable vane of a turbomachine. The invention also relates to an axial turbomachine, in particular an aircraft turbojet engine or turboprop engine.

BACKGROUND

Ordinarily, several rows of orientable vanes are fitted to a stator casing of a turbojet engine compressor. Such vanes can pivot while the engine is in operation. Their arched blades tilt in relation to the primary flow which they pass through, as a result of which their action can be adjusted in relation to engine operating conditions and flight conditions. Operating range and performance are thus extended.

With a view to simplifying mounting, or more simply so that mounting can be physically possible, the inner shroud suspended on the orientable vanes can be divided into two axial parts. These two parts may join together so as to enclose the rotating bearings around the inner trunnions of the orientable vanes.

Document FR 3 009 335 A1 discloses a device for guiding redirecting vanes having variable angle settings for a turbomachine. The device comprises a casing from which a row of adjustable vanes extends radially. An inner shroud is attached to these adjustable vanes. The inner shroud is suspended on the adjustable vanes via cylindrical bushes fitted around the inner trunnions of the adjustable vanes. The inner shroud is assembled by bringing its axial parts together, while tightening the cylindrical bushes. However, this assembly operation is complicated, as temporarily holding the bushes in a part of the shroud is unstable. In addition to this, the operation of bringing part of the shroud against the bushes is complicated because matching the parts of the shroud is disturbed by the presence of the bushes, and these parts are relatively flexible. In addition to this, these bushes are not very stable in their recesses.

SUMMARY

The invention is intended to solve at least one of the problems raised by the prior art. More specifically, the invention relates to improving the retention of a bearing connecting an orientable vane to a shroud. The invention also relates to the provision of a simple solution that is strong, light, economical, reliable, easy to manufacture, convenient to maintain, leak tight and easy to inspect.

The invention relates to a stator assembly for an axial turbomachine, in particular for a compressor of a turbomachine, the assembly comprising: a shroud, in various instances an inner shroud, that is axially divided into two parts; a pocket formed in the shroud; a bearing located in the pocket; and an orientable vane pivotably mounted in the bearing about a pivot axis; wherein the shroud comprises an axial interface separating the parts that is axially offset in relation to the pivot axis of the orientable vane.

According to various advantageous embodiments of the invention, the bearing provides a seal between the orientable vane and the inner shroud, the bearing in various instances wholly filling the pocket.

According to various advantageous embodiments of the invention, the separating interface axially delimits the bearing, one of the parts in various instances comprising a flat circular surface in contact with the bearing.

According to various advantageous embodiments of the invention, the assembly comprises a one-piece outer shroud on which the orientable vane is mounted.

According to various advantageous embodiments of the invention, the bearing is longer axially than wide in circumference, and/or wider than its radial thickness.

According to various advantageous embodiments of the invention, the pocket comprises a sealed base, that can in various instances be in contact with the bearing.

According to various advantageous embodiments of the invention, the bearing has two generally parallel lateral faces, the faces in various instances extending over most of the axial length of the bearing.

According to various advantageous embodiments of the invention, the pocket is mostly or wholly formed in one of the parts, in various instances in the upstream part.

According to various advantageous embodiments of the invention, the downstream part comprises an annular seal, in various instances with an abradable material, that is axially and/or radially separated from the bearing.

According to various advantageous embodiments of the invention, the bearing comprises an outer face with a flat and circular surface.

According to various advantageous embodiments of the invention, the bearing comprises an axially eccentric through opening.

According to various advantageous embodiments of the invention, the bearing comprises means for immobilizing rotation, in particular a flat face, acting together with a wall of the pocket.

According to various advantageous embodiments of the invention, the bearing comprises a portion of radial excess thickness partly forming the outer surface of the shroud.

According to various advantageous embodiments of the invention, the orientable vane comprises a disc with a perimeter, the portion of excess thickness axially separating the disc from one of the parts.

According to various advantageous embodiments of the invention, the bearing comprises a semi-circular axial portion.

According to various advantageous embodiments of the invention, the bearing surrounds the inner trunnion and/or is of one piece.

According to various advantageous embodiments of the invention, the bearing wholly fills the pocket between the vane and the shroud.

According to various advantageous embodiments of the invention, at least one or each part of the shroud is of one piece.

According to various advantageous embodiments of the invention, the inner shroud or one of the parts has a general profile in revolution that is longer, or at least twice as long, or at least three times as long axially than it is thick radially.

According to various advantageous embodiments of the invention, the pivot axis of the orientable vane is within one of the parts, and/or is axially at a distance from the other of the two parts.

According to various advantageous embodiments of the invention, the pivot axis of the orientable vane is within the annular envelope of one of the parts, and/or is axially at a distance from the annular envelope of the other of the two parts.

According to various advantageous embodiments of the invention, the sealed base is in contact with the bearing over its entire axial length.

According to various advantageous embodiments of the invention, the depth of the pocket increases in the upstream direction, in particular at the excess thickness of the bearing.

According to various advantageous embodiments of the invention, at least one of the parts comprises axial partition walls separating the pockets.

According to various advantageous embodiments of the invention, the pocket is outside or delimited by the axial interface.

The invention also relates to an assembly for an axial turbomachine stator, the assembly comprising: a shroud that is axially divided into two parts via an axial separation interface; a pocket formed in the shroud; a bearing located in the pocket; and an orientable vane pivotably mounted in the bearing about a pivot axis; wherein the pocket comprises a sealed base, that can be in contact with the bearing.

The invention also relates to an assembly for an axial turbomachine stator, the assembly comprising: a shroud that is axially divided into two parts via an axial separation interface and which comprises an annular surface for guiding an annular flow of the turbomachine; a pocket formed in the shroud; a bearing located in the pocket; and an orientable vane pivotably mounted in the bearing about a pivot axis; wherein the bearing comprises a portion of excess radial thickness partly forming the guide surface of the shroud.

The invention also relates to a turbomachine comprising a stator assembly, wherein the assembly is in accordance with the invention, in various embodiments the turbomachine comprises an intermediate casing with an inner hub.

According to various advantageous embodiments of the invention, the intermediate casing comprises a downstream face, the assembly being mounted on the downstream face.

According to various advantageous embodiments of the invention, one of the parts of the shroud is in contact with the inner hub, and/or one of the parts of the shroud is axially at a distance from the inner hub.

According to various advantageous embodiments of the invention, one of the two parts physically connects the hub to other of the two parts.

The invention also relates to a process for assembling a stator assembly of a turbomachine, the assembly comprising an outer shroud, an inner shroud with a pocket occupied by a rotating bearing connected to an orientable vane, the inner shroud being divided axially into a first part and a second part, the process comprising the following stages: fitting a first part of the shroud; radially inserting the orientable vane into a support; radially engaging the bearing inside the orientable vane; wherein the bearing has an axial guide face, and in that the process further comprises a stage of fitting the second part by sliding it against the axial guide face of the bearing; the assembly in various instances conforming to the invention.

According to various advantageous embodiments of the invention, during the stage of engagement, the bearing slides radially against the first part, in particular against the downstream part.

According to various advantageous embodiments of the invention, during stage of fitting a first part, the part acts together with a device sealing the rotor of the turbomachine.

In general, the advantageous embodiments of each object of the invention also apply to the other objects of the invention. Insofar as possible, each object of the invention can be combined with the other objects. The objects of the invention can also be combined with the embodiments in the description, which are furthermore capable of being combined together.

The invention optimizes how the bearings are secured as a result of their asymmetry that acts upon the parts of the shroud. Offsetting the interface between the parts also makes it possible to offer more space for the use of a temporary tool for holding the bushes. In addition to this, the perimeter of the bearings makes it easier for them to find their place in the pockets. The stator is more economical to manufacture.

The configuration of the parts of the shroud, together with the filling nature of the bearings, increases the sealing and therefore the performance of the turbomachine. The closed form of the bottom of the pockets further increases the sealing, while increasing the rigidity of the corresponding part.

DRAWINGS

DETAILED DESCRIPTION

In the following description, the terms inner and outer relate to a position relating to the axis of rotation of an axial turbomachine. The axial direction corresponds to the direction along the axis of rotation of the turbomachine. The radial direction is perpendicular to the axis of rotation. Upstream and downstream relate to the direction of the main flow within the turbomachine.

Figure 1:
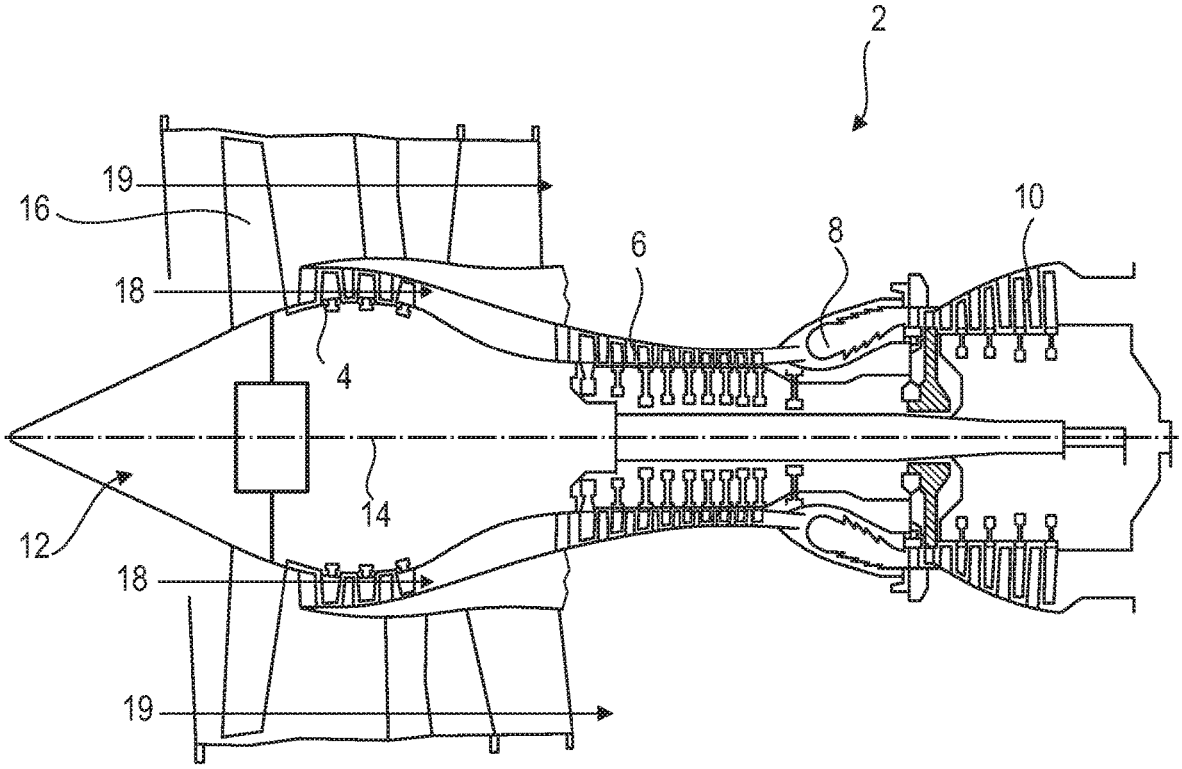
FIG. 1 shows an axial turbomachine according to various embodiments of the invention.

FIG. 1 illustrates an axial turbomachine in a simplified manner. In this exemplary embodiment it is a dual-flow turbojet engine. Turbojet engine 2 comprises a first compression stage, known as the low-pressure compressor 4, a second compression stage, known as the high-pressure compressor 6, a combustion chamber 8 and one or more stages of turbines 10. When in operation, the mechanical power of turbine 10 transmitted via the central shaft to rotor 12 causes the two compressors 4 and 6 to move. The latter comprise several rows of rotor blades associated with rows of stator vanes. Rotation of the rotor about its axis of rotation 14 thus makes it possible to generate a flow of air and progressively compress it until it enters combustion chamber 8.

An inlet fan commonly referred to as a fan or blower 16 is connected to rotor 12 and generates a flow of air which is divided into a primary flow 18 passing through the various abovementioned stages of the turbomachine, and a secondary flow 19 passing through an annular conduit (partly shown) generating a thrust useful for propulsion of an aircraft.

Figure 2:
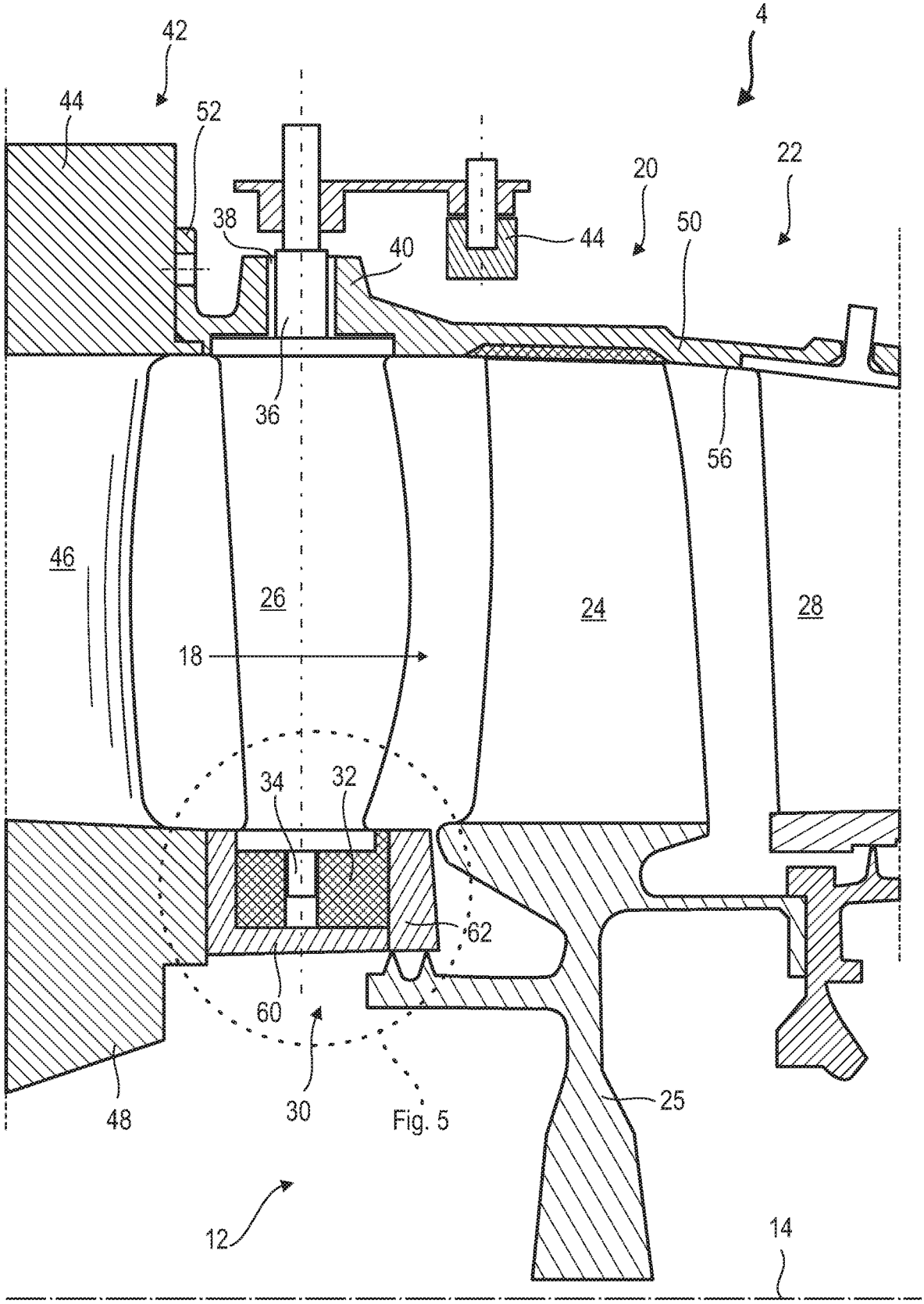
FIG. 2 shows a portion of a turbomachine compressor according to various embodiments of the invention.

FIG. 2 is a view in cross section of a portion of a compressor of an axial turbomachine such as that in FIG. 1. The compressor can be a low-pressure compressor 4.

The compressor comprises a stator 20 with an outer shroud 22 of one piece that can form the outer casing of the compressor. Outer shroud 22 is of one piece. It forms a closed loop. It has circular continuity of material and/or circular uniformity. It can be of one piece over its entire length. It can comprise a portion that is integrally joined.

Rotor 12 can comprise several rows of rotor blades 24, for example two or three or more rotor rows (only one is visible). Despite the rotation of rotor 12, the inclination of the chords of rotor blades 24 in space remains unchanged in relation to axis of rotation 14. Rotor blades 24 can form a one-piece disc; particularly they cannot be dissociated from their supporting rim 25. Such an arrangement is also known by the term "blisk".

Compressor 4 comprises several redirecting members, for example at least two, or at least three or at least four redirecting members. Each redirecting member comprises an annular row of stator vanes 26. These vanes are stator vanes in the meaning that they are mounted on stator 20 and therefore remain in contact with the latter. The redirecting members are associated with the fan or with a row of rotor blades 24 to redirect their airflows, so as to convert the velocity of the flow into a static pressure.

Stator vanes 26 comprise controlled-orientation stator vanes 26. These orientable vanes 26 extend radially towards the interior of outer shroud 22 and form an annular row. These orientable vanes 26 are also known as variable setting vanes, or by the English acronym VSV, for Variable Stator Vane. Their special feature is that they can pivot on themselves, so that the inclination of their chords can vary in relation to the axis of rotation 14 of compressor 4, and do so while it is in operation.

Through their chords the vanes can sweep through an angle of at least 30° between two extreme positions. Their inner and outer faces can be exposed to primary flow 18 to a greater or lesser extent. Orientable vanes 26 can pivot in relation to flow 18, although they cover a greater or lesser part of the fluid flow thanks to their blades. They intercept primary flow 18 more. The circumferential width that they occupy can vary. Their leading edges and their trailing edges can be closer to or further away from the vanes in the same row. Being inclined to a greater or lesser extent in relation to the general direction of flow, they deviate primary flow 18 to a greater or lesser extent to modulate the flow redirection that they provide. Thus, the turbomachine and the compressor can follow different performance curves when in operation. The stator vanes can also comprise other annular rows of vanes 28; these other vanes can in various instances have a fixed orientation or have a controlled orientation.

Stator 20 of compressor 4 comprises an inner shroud 30 suspended on the inner extremities of orientable vanes 26, while at the same time retaining the pivoting nature of orientable vanes 26. For this purpose, inner shroud 30 is fitted with rotating bearings 32 that are mounted about inner trunnions 34 of orientable vanes 26. Radially opposite, orientable vanes 26 have outer trunnions 36 engaged in openings 38, that can optionally be formed through bosses 40. The trunnions (34, 36) can form cylindrical rods, and can be of one piece with their blade. The system for controlling orientable vanes is well known to those skilled in the art and will not be further detailed.

Stator 20 comprises an intermediate casing 42 forming part of the load bearing structure of the turbomachine. This intermediate casing 42 can receive a separating lip (not shown). Intermediate casing 42 can comprise an outer portion 44, casing arms 46 forming supports passing through primary flow 18, and an inner hub 48 that can reach inner shroud 30.

Outer shroud 22 can comprise an annular wall 50 and an upstream flange 52 attached to the outer portion 44 of intermediate casing 42. Wall 50 can be integrally joined. It can extend over the entire axial length of orientable vanes 26 and in various instances other vanes.

According to one option for the invention, inner surface 56 of outer shroud 22 has an internal diameter that decreases downstream and complements the outer extremities of rotor blades 24. This configuration therefore makes it necessary to locate rotor blades 24 within outer shroud 22 before mounting orientable blades 26 and their inner shroud 30. The opposite would not be physically possible because of the one-piece nature of outer shroud 22.

As a response to this technical constraint, inner shroud 30 is divided. It is divided axially into an upstream part 60 and a downstream part 62. Each of these parts can form a closed loop. At least one or each part (60; 62) is of one piece, particularly it/they has/have circular continuity of material. Alternatively, one of them is angularly segmented. However, a one-piece configuration improves rigidity and the securing of inner shroud 30 by means of inner trunnions 34 forming pivot connections; that is a mechanical connection with a single degree of freedom.

Although just one orientable vane 26 and just one bearing 32 can be seen, the present teaching can apply to the entire row.

Figure 3:
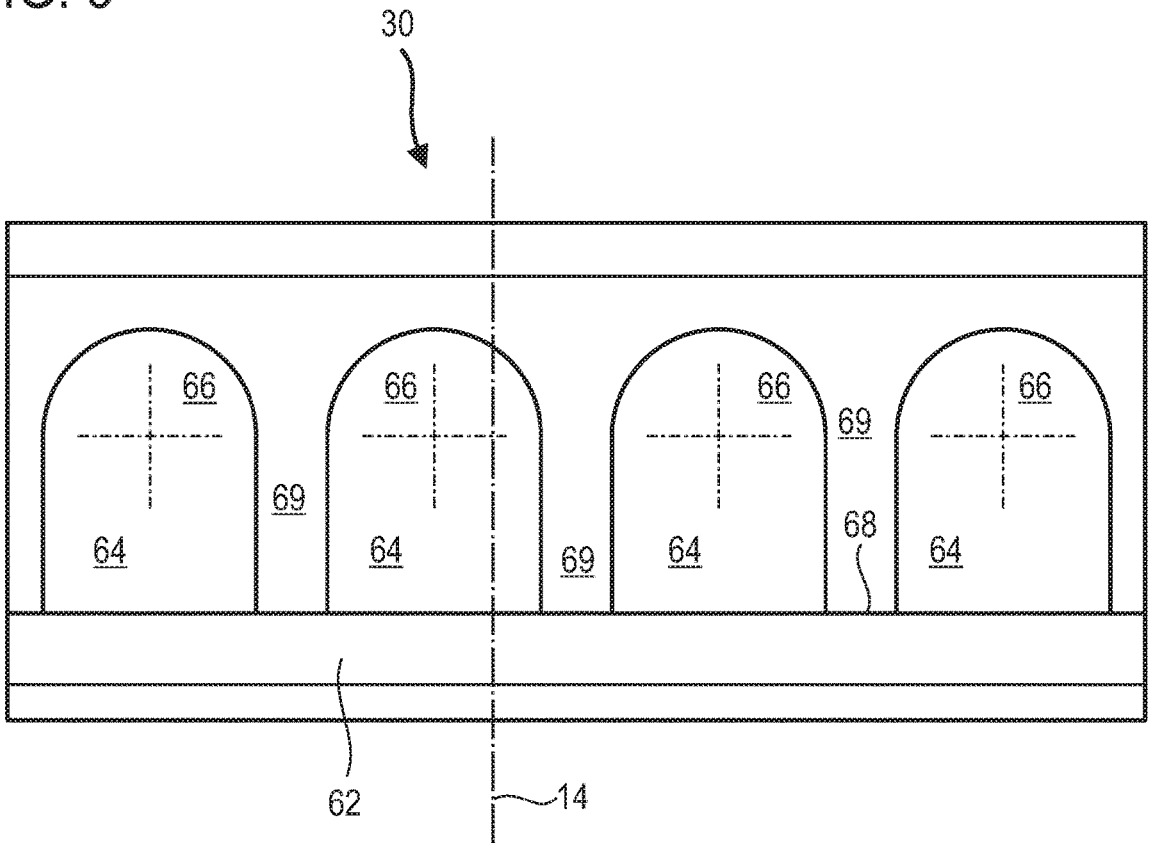
FIG. 3 illustrates a flat portion of the shroud according to various embodiments of the invention.

FIG. 3 provides a sketch in plan view of inner shroud 30 in FIG. 2, the bearings not being shown for reasons of clarity. Axis of rotation 14 is indicated.

Upstream part 60 and downstream part 62 are illustrated from the outside. Upstream part 60 has an annular row of pockets 64, of that four are shown. Pockets 64 each have an enclosed base 66 providing a seal against downstream part 62. They can end against axial separation interface 68 of the axial parts (60; 62). Axial separation interface 68 can be a plane perpendicular to axis of rotation 14, or can be substantially tapered. Pockets 66 are in the shape of an upside-down letter "U", the bearings being of a shape complementing that of pockets 64. These pockets 64 are separated by sealing walls 69.

Figure 4:
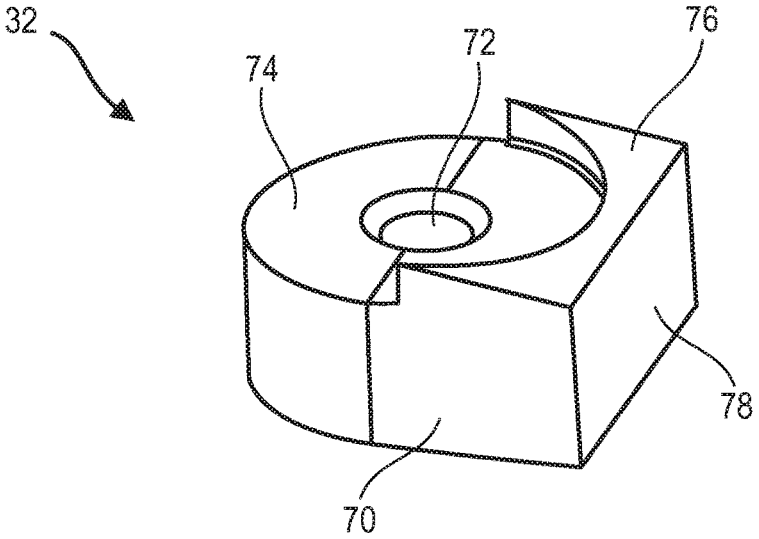
FIG. 4 is an isometric view of a bearing according to the various embodiments of invention.

FIG. 4 illustrates bearing 32 in an isometric view, the bearing in various instances corresponding to the bearing illustrated in connection with FIGS. 2 and 3.

Bearing 32 is of one piece. It has a semi-cylindrical upstream portion, and a rectangular downstream portion provided with axial guide lateral faces 70. These faces 70 can be parallel. An opening 72 intended to receive the inner trunnion of the orientable vane is at the interface between portions. A flat face 74 in the form of a disc surrounds opening 72. Complementing this, the bearing has a radial excess thickness 76 that is raised in relation to flat face 74. Excess thickness 76 can join one axial extremity of the bearing, for example its flat downstream face 78, enabling it to be blocked in rotation against the downstream part of the shroud.

Although a single bearing 32 is shown, this teaching can apply to the entire annular row.

Figure 5:
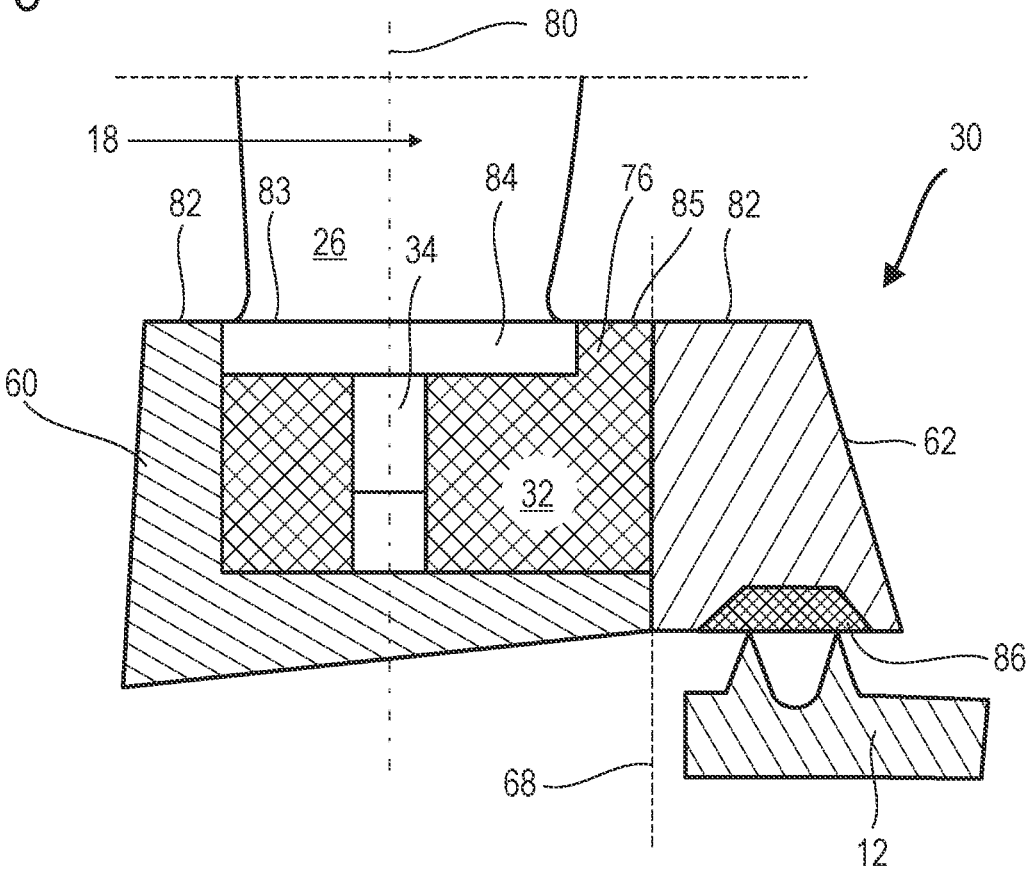
FIG. 5 illustrates a magnified view of the inner shroud in FIG. 2, according to various embodiments of the invention.

FIG. 5 corresponds to a magnified view of a delimited area in FIG. 2. The cross section of inner shroud 30 corresponding to an orientable vane 26 and its bearing 32 coincides with the pivot axis 80 of internal trunnion 34.

Pivot axis 80 is distant from axial interface 68 between the parts (60; 62). This allows bearing 32 to be better secured in one of the parts; in the case in point in upstream part 60. The spacing can be measured over the material of shroud 30.

The shroud comprises a radially outer surface 82 guiding the air flow 18. The bearing 32 comprises a radially outer surface 85 guiding the air flow 18, the outer surface 85 being flush with the outer surface 82 of the shroud. A portion of the bearing 32 with excess thickness 76 projects from the exterior of shroud 30. The portion of excess thickness 76 forms the outer surface 85. This portion of excess thickness 76 makes it possible to fill a space in shroud 30 while accommodating to its compact nature. For example, the profile of the inner shroud can be of a length that is greater than or twice its radial thickness. The portion of excess thickness 76 can form a separation between downstream part 62 and a disc plate 84 of the orientable vane 26. In particular, it can slide against the cylindrical perimeter of disc 84. The disc 84 comprises a radially outer surface 83 that guides the air flow 18 and that is flush with the outer surface 82 of the shroud and with the outer surface 85 of the bearing 32.

Rotor 12 acts together in a sealed way with downstream part 62, in various instances at abradable seal 86. Bearing 32 does not overlap annular seal 86 because interface 68 separates them.

Figure 6:
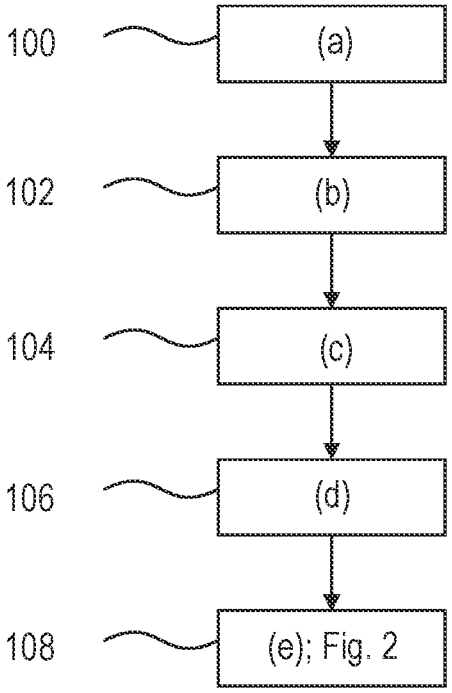
FIG. 6 shows a diagram of the process for assembling an assembly for a turbomachine stator according to various embodiments of the invention.

FIG. 6 is a diagram of a process for the assembly of a turbomachine.

The components of the turbomachine can correspond to those described in connection with FIGS. 1 to 5.

In various embodiments, the process can comprise the following stages, that can be carried out in the following order:

(a)—arrangement 100 of the outer shroud around the rotor;

(b)—fitting 102 of the downstream part of the inner shroud;

(c)—radially inserting 104 the orientable vane in the outer shroud;

(d)—radially engaging 106 the bearing within the orientable vane;

(e)—fitting 108 the upstream part of the inner shroud by sliding it axially against the axial guide face of the bearing.

During fitting 102 in stage (b), the first part fitted is in contact with the rotor, for example around and/or in contact with a rotor seal. This seal can be a set of sealing elements. The seal can center the downstream part with respect to the rotor. The other part can be free of any seal.

During engagement 106 in stage (d), the bearing slides radially against the first part, in particular against the downstream part, and is fitted around the inner trunnion of the orientable vane.

During fitting 108 in stage (e), the upstream part is moved along axially while being guided by the guide faces. Because the bearings can rotate in relation to the trunnions, they turn in such a way as to position themselves axially in their pockets, making it simpler to get closer to the upstream part.

What is claimed is:

1. A stator assembly for an axial turbomachine, said stator assembly comprising:

a shroud that is axially divided into two parts by an axial interface separating the two parts, the two parts being a first part and a second part, each part of the shroud having an outer surface guiding an air flow;

a plurality of pockets formed in the shroud, the pockets being arranged as a row of circumferentially adjacent pockets, each pocket of the plurality of pockets being separated from an adjacent pocket of the plurality of pockets by a sealing wall;

a plurality of one-piece bearings, each located in one respective pocket of the plurality of pockets, and each one-piece bearing comprising a portion of radial excess thickness with an outer surface guiding an air flow, the outer surface of each one-piece bearing being arranged flush with the outer surface of the two parts of shroud; and a plurality of orientable vanes, each orientable vane being pivotably mounted in a respective bearing of the plurality of bearings about a respective pivot axis that is axially remote from the axial interface, wherein each bearing of the plurality of bearings comprises an axially eccentric through opening defining said respective pivot axis, wherein each orientable vane comprises a disc with an outer surface, wherein the outer surface of the disc is flush to the outer surface of the first part of the shroud, and wherein the outer surface of the disc is flush to the outer surface of the one-piece bearing, wherein the portion of excess thickness axially separates the disc from the second part of the shroud.

2. The stator assembly according to claim 1, wherein each bearing of the plurality of bearings provides a seal between the respective orientable vane and the shroud, the bearing wholly filling the pocket.

3. The stator assembly according to claim 1, wherein the separating interface axially delimits each bearing of the plurality of bearings, one of the two parts comprising a flat circular surface in contact with each bearing of the plurality of bearings.

4. The stator assembly according to claim 1, further comprising a one-piece outer shroud on which the orientable vanes of the plurality of vanes are mounted.

5. The stator assembly according to claim 1, wherein each bearing of the plurality of bearings is longer axially than wide in circumference; and its width is greater than its radial thickness.

6. The stator assembly according to claim 1, wherein each pocket of the plurality of pockets comprises a sealed base that is in contact with the respective bearing of the plurality of bearings.

7. The stator assembly according to claim 1, wherein each bearing of the plurality of bearings has two parallel lateral faces.

8. The stator assembly according to claim 1, wherein each pocket of the plurality of pockets is wholly formed in one of the two parts.

9. The stator assembly according to claim 1, wherein one of the two parts is a downstream part and comprises an annular seal, the annular seal enclosing an abradable material that is axially and radially separated from the bearing.

10. The stator assembly according to claim 1, wherein each bearing of the plurality of bearings comprises a portion for immobilizing rotation, the portion exhibiting a flat face acting together with a wall of the respective pocket.

* * * * *